US005474417A

United States Patent [19]

Privett et al.

[11] Patent Number: 5,474,417

[45] Date of Patent: Dec. 12, 1995

[54] CAST CASING TREATMENT FOR COMPRESSOR BLADES

[75] Inventors: John D. Privett, North Palm Beach; William P. Byrne, Jupiter; Nick A. Nolcheff, Palm Beach Gardens, all of Fla.

[73] Assignee: United Technologies Corporation, Hartford, Conn.

[21] Appl. No.: 365,874

[22] Filed: Dec. 29, 1994

[51] Int. Cl.[6] ..... F01D 1/12

[52] U.S. Cl. ..... 415/58.5; 415/58.7; 415/57.4; 415/173.1; 415/914

[58] Field of Search ..... 415/57.3, 57.4, 415/58.5, 58.7, 144, 173.1, 173.4, 914

[56] References Cited

U.S. PATENT DOCUMENTS

| | | | |
|---|---|---|---|
| 3,011,762 | 12/1961 | Pouit | 415/914 |
| 4,630,993 | 12/1986 | Jensen | 415/914 |
| 4,990,053 | 2/1991 | Rohne | 415/914 |
| 5,282,718 | 2/1994 | Koff et al. | 415/57.3 |
| 5,308,225 | 5/1994 | Koff et al. | 415/57.3 |

FOREIGN PATENT DOCUMENTS

| | | | |
|---|---|---|---|
| 63-183204 | 7/1988 | Japan | 415/914 |
| 6-207558 | 7/1994 | Japan | 415/58.5 |
| 45457 | 4/1939 | Netherlands | 415/914 |
| 504214 | 4/1939 | United Kingdom | 415/144 |

*Primary Examiner*—Edward K. Look
*Assistant Examiner*—James A. Larson
*Attorney, Agent, or Firm*—Christopher T. Hayes

[57] ABSTRACT

A tip shroud assembly comprising a segmented annular shroud, each segment comprising first, second and third arcuate members and a plurality of vane walls integral with the first second and third members, and each arcuate member has a radially inner surface, and the third arcuate member is in spaced relation to the first and second members, and each vane wall spans between the radially inner surface of the third arcuate member and the radially inner surfaces of the first and second members.

5 Claims, 3 Drawing Sheets

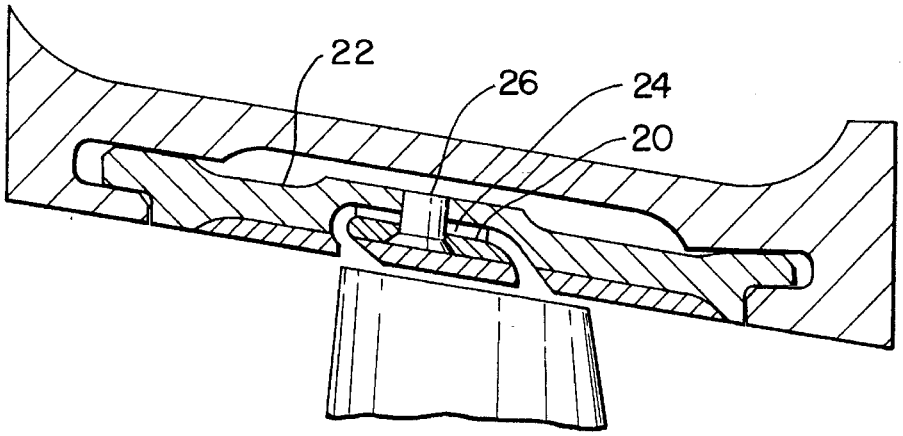
FIG. 2
(PRIOR ART)
FIG. 3
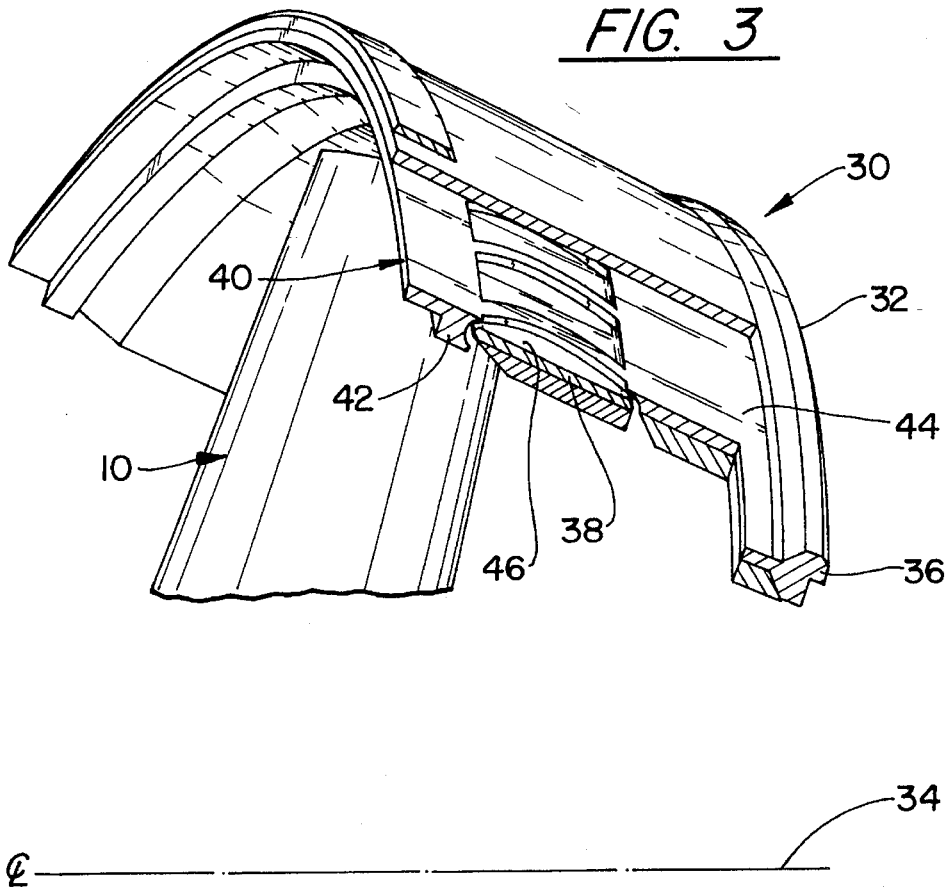

CAST CASING TREATMENT FOR COMPRESSOR BLADES

DESCRIPTION

1. Technical Field

This invention relates to tip shroud assemblies of axial flow gas turbine engine compressors, and specifically to such shrouds which recirculate air at the tips of airfoil in the compressor to reduce the likelihood of compressor stall.

2. Background Art

In an axial flow gas turbine engine, such as the type used on aircraft, air is compressed in a compressor section, mixed with fuel combusted in a combustor section, and expanded through a turbine section that, via one or more shafts, drives the compressor section. The overall efficiency of such engines is a function of, among other factors, the efficiency with which the compressor section compresses the air. The compressor section typically includes a low pressure compressor driven by a shaft connected to a low pressure turbine in the turbine section, and a high pressure compressor driven by a shaft connected to a high pressure turbine in the turbine section. The high and low compressors each include several stages of compressor blades rotating about the longitudinal axis 100 of the engine, as shown in FIG. 1. Each blade 10 has an airfoil 12 that extends from a blade platform 14 and terminates in a blade tip 16, and the blade tips 16 rotate in close proximity to an outer air seal 18, or "tip shroud". The tip shroud 18 extends circumferentially about the blade tips 16 of a given stage, and the blade platforms 14 and the tip shroud 18 define the radially inner and outer boundaries, respectively, of the airflow gaspath through the compressor.

The stages are arranged in series, and as air is pumped through each stage, the air experiences an incremental increase in pressure. The total pressure increase through the compressor is the sum of the incremental pressure increases through each stage, adjusted for any flow losses. Thus, in order to maximize the efficiency of a gas turbine engine, it would be desirable, at a given fuel flow, to maximize the pressure rise (hereinafter referred to as "pressure ratio") across each stage of the compressor.

Unfortunately, one of the problems facing designers of axial flow gas turbine engines is a condition known as compressor stall. Compressor stall is a condition in which the flow of air through a portion of a compressor stage ceases, because the energy imparted to the air by the blades of the compressor stage is insufficient to overcome the pressure ratio across the compressor stage. If no corrective action is taken, the compressor stall may propagate through the compressor stage, starving the combustor of sufficient air to maintain engine speed. Under some circumstances, the flow of air through the compressor may actually reverse direction, in what is known as a compressor surge. Compressor stalls and surges on aircraft powerplants are engine anomalies which, if uncorrected, can result in loss of the aircraft and everyone aboard.

Compressor stalls in the high compressor are of great concern to engine designers, and while compressor stalls can initiate at several locations within a given stage of a compressor, it is common for compressor stalls to propagate from the blade tips where vortices occur. It is believed that the axial momentum of the airflow at the blade tips tends to be lower than at other locations along the airfoil. From the foregoing discussion it should be apparent that such lower momentum could be expected to trigger a compressor stall.

As an aircraft gas turbine engine accumulates operating hours, the blade tips tend to wear away the tip shroud, increasing the clearance between the blade tips and the tip shroud. As those skilled in the art will readily appreciate, as the clearance between the blade tip and the tip shroud increases, the vortices become greater, resulting in a larger percentage of the airflow having the lower axial momentum discussed above. Accordingly, engine designers have sought to remedy the problem of reduced axial momentum at the blade tips of high compressors.

An effective device for treating tip shrouds to desensitize the high pressure compressor of an engine to excessive clearances between the blade tips and tip shrouds is shown and described in U.S. Pat. No. 5,282,718 issued Feb. 4, 1994, to Koff et al, which is hereby incorporated by reference herein. In practice, the tip shroud assembly disclosed in U.S. Pat. No. 5,282,718, is composed of an inner ring 20 and outer ring 22 as shown in FIG. 2. In the high pressure compressor application, the rings 20, 22 are initially forged, and hundreds of small, complicated vanes 24 are machined onto one of the rings 20, 22. The inner ring 20 and outer ring 22 are then segmented, and the inner ring 20 is attached to the outer ring 22 by use of attachments 26 such as bolts, rivets, welding or a combination thereof. Unfortunately, experience has shown that although effective, the tip shroud assembly of the prior art is costly due to the large mount of time required to machine the vanes 24. In addition to cost concerns, the use of attachments such as bolts or rivets, which could liberate into the engine's flowpath, is a maintainability and safety concern. Likewise, the task of alignment of the inner and outer rings 20, 22 and the control of distortion of the prior art shroud assembly is made more difficult by the use of bolts or rivets.

What is needed is a tip shroud assembly which provides the benefits of the prior art yet eliminates the problems caused by the use of bolts or rivets, and provides a significant reduction in manufacturing cost, while increasing the maintainability and safety as compared to the prior art.

SUMMARY OF THE INVENTION

It is therefore an object of the present invention to provide a tip shroud assembly which provides the benefits of the prior art tip shrouds yet eliminates the problems caused by the use of bolts or rivets.

Another object of the present invention is to provide a tip shroud assembly which provides the benefits of the prior art tip shrouds yet provides a significant reduction in manufacturing cost, while increasing the maintainability and safety as compared to the prior art.

According to the present invention, a tip shroud assembly is disclosed comprising a segmented annular shroud, each segment comprising first, second and third arcuate members and a plurality of vane walls integral with the first second and third members, and each arcuate member has a radially inner surface, and the third arcuate member is in spaced relation to the first and second members, and each vane wall spans between the radially inner surface of the third arcuate member and the radially inner surfaces of the first and second members.

The foregoing and other features and advantages of the present invention will become more apparent from the following description and accompanying drawings.

BRIEF DESCRIPTION OF THE DRAWINGS

FIG. 2 is a cross sectional view of a tip shroud of the type disclosed in U.S. Pat. No. 5,282,718.

FIG. 3 is a cross sectional perspective view of a tip shroud of the present invention.

BEST MODE FOR CARRYING OUT THE INVENTION

Figure 1:
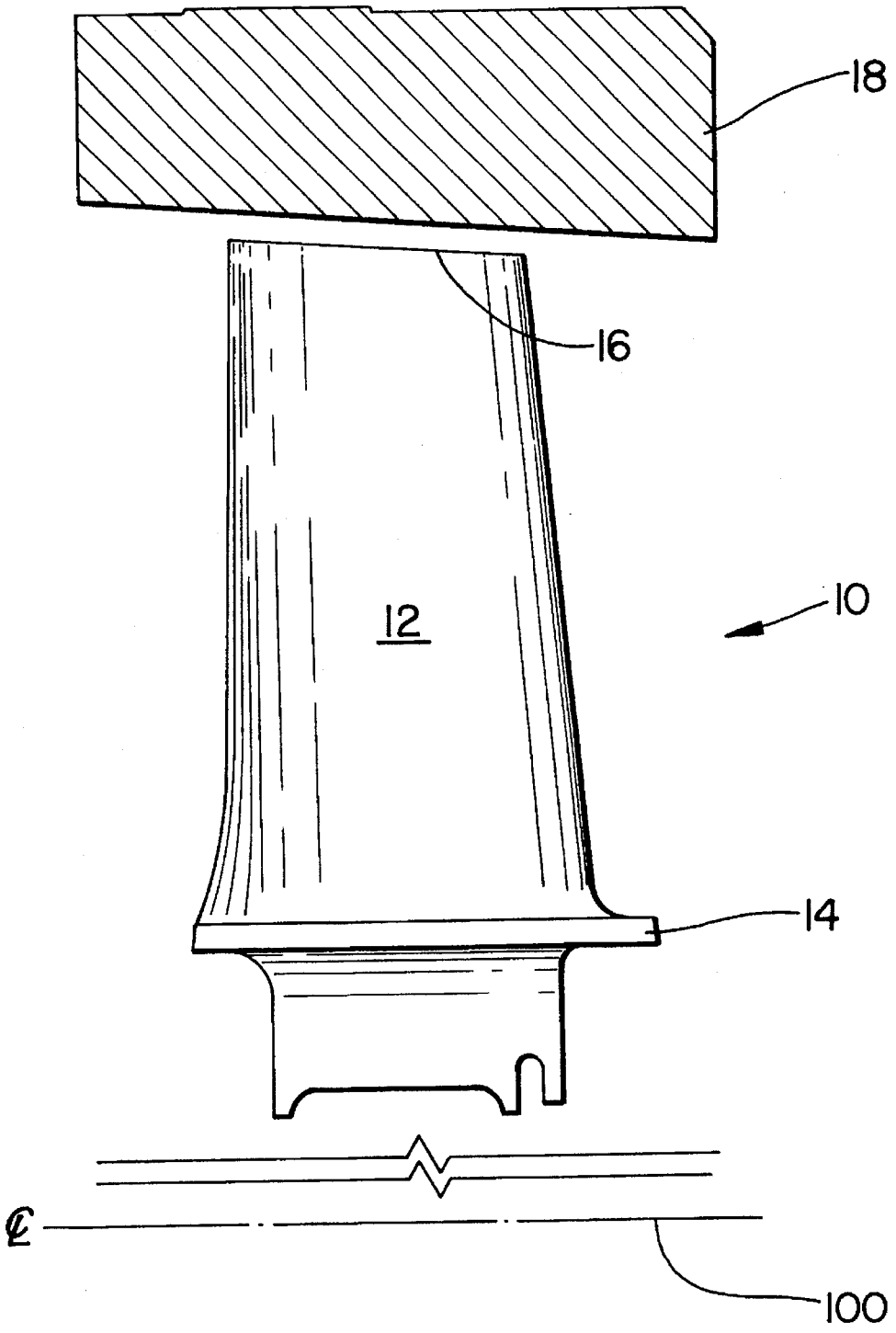
FIG. 1 (PRIOR ART)
FIG. 1 is view of a compressor blade and tip shroud of the prior art.
Figure 4:
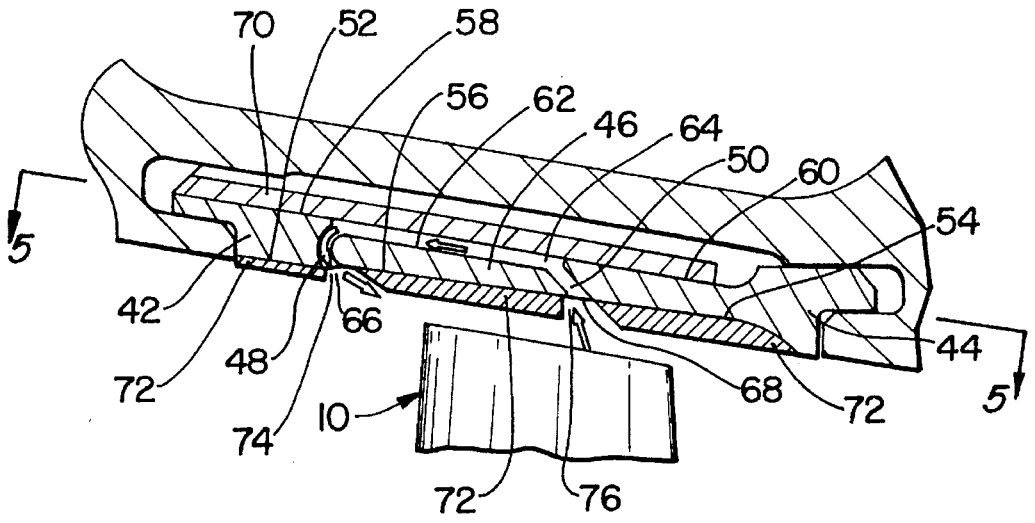
FIG. 4 is a cross sectional view of the tip shroud of the present invention.

As shown in FIG. 3, the tip shroud assembly 30 of the present invention comprises an annular shroud 32 extending circumferentially about a reference axis 34 which, once the assembly 30 is placed into an engine, defines the longitudinal axis 100 of the engine. The annular shroud 32 is comprised of a plurality of arcuate shroud segments 36, one of which is shown in FIG. 3, and each segment comprises a cast body in which the outer shroud 40 and the inner shroud 38 are cast from suitable material in one piece. The outer shroud 40 includes a first arcuate member 42 and a second arcuate member 44, and the inner shroud 38 comprises a third arcuate member 46 interposed between the first and second arcuate members 42, 44. As shown in FIG. 4, the third arcuate member is in spaced relation to the first arcuate member 42 defining a first gap 48 therebetween. The first gap 48 extends circumferentially about the reference axis 34 and has a first predetermined length. The third arcuate member 46 is in spaced relation to the second arcuate member 44 defining a second gap 50 therebetween. The second gap 50 also extends circumferentially about the reference axis 34 and has a second predetermined length. Each of the arcuate members 42, 44, 46 has a radially inner surface 52, 54, 56 facing the reference axis 34, which radially inner surfaces 52, 54, 56 preferably define sections of a cone, and a radially outer surface 58, 60, 62 facing away from the reference axis 34.

Figure 5:
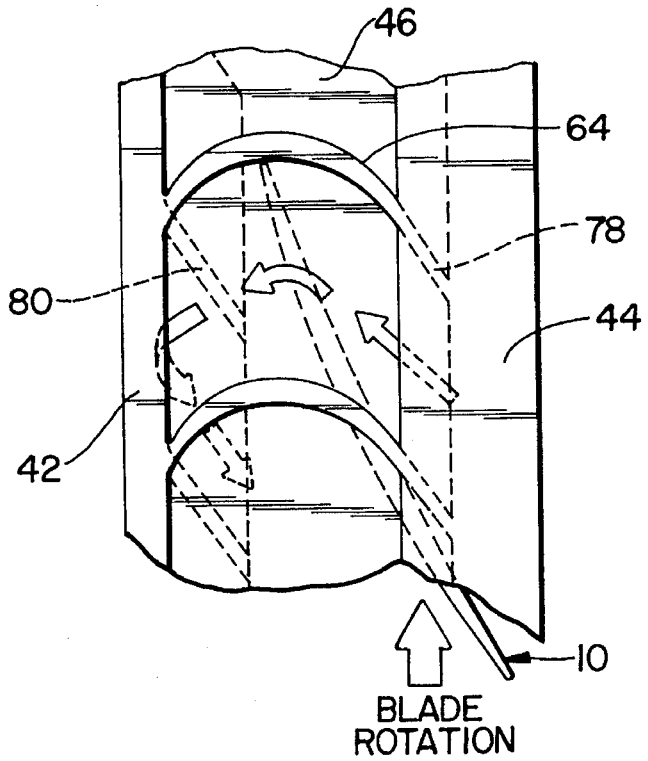
FIG. 5 is a cross sectional view of the tip shroud of the present invention taken along line 5—5 of FIG. 4.

Each shroud segment 36 includes a plurality of vane walls 64, and as shown in FIG. 3, each vane wall 64 is integral with the first 42, second 44 and third 46 arcuate members. Referring again to FIG. 4, each vane wall 64 has a first end 66 and a second end 68, and the first end 66 of each vane wall 64 spans the first gap 48 thereby connecting the radially inner surfaces 52, 56 of the first and third arcuate members 42, 46. The second end 68 of each vane wall 64 spans the second gap 50, thereby connecting the radially inner surfaces 54, 56 of the second and third arcuate members 44, 46. As shown in FIGS. 4 and 5, each of the vane walls 64 extends from the first arcuate member 42 to the second arcuate member 44. As shown in FIGS. 3 and 4, the tip shroud assembly 30 of the present invention also includes a backing sheet 70 which spans between the first and second arcuate members 42, 44 and is sealingly secured to the radially outer surfaces 58, 60 thereof, preferably by brazing. The backing sheet 70 is in spaced relation to the radially outer surface 62 of the third arcuate member 46, and each of the vane walls 64 extends from the third arcuate member 46 to the backing sheet 70 and is sealingly secured thereto, also preferably by brazing. A layer 72 of abradable material of the type known in the art is attached to the radially inner surfaces 52, 54, 56 of the first, second and third arcuate members 42, 44, 46 as needed for the particular engine application. The abradable material extends radially inward from the radially inner surfaces 52, 54, 56, and the layer has first 74 and second 76 annular channels therein. The first channel 74 is located radially inward from the first gap 48 and extends along the entire first predetermined length thereof. The first channel 74 is in communication with the first gap 48 along the entire first predetermined length thereof. Likewise, the second channel 76 is located radially inward from the second gap 50 and extends along the entire second predetermined length thereof. The second channel 76 is in communication with the second gap 50 along the entire second predetermined length thereof. As an alternative to use of a separate backing sheet 70, the backing sheet may be cast integrally with the arcuate members 42, 44, 46 and vanes 64.

The vanes 64 of the present invention differ from those of the prior art in that they provide a structural as well as an aerodynamic function. The vanes 64 of the present invention replace all other fastening techniques in holding the inner shroud 38 to the outer shroud 40. In addition to eliminating mechanical attachments, this eliminates alignment problems and potential weld distortions. The many attachment points between the backing sheet 70 and the cast body stiffens the shroud assembly 30 and reduces its susceptibility to large deflections and high cycle fatigue.

The vanes 64 of the present invention span a greater distance than those of the prior art in that they run from the radially inner surfaces 54, 56 of the second and third arcuate segments 44, 46 to the radially inner surfaces 52, 56 of the first and third arcuate segments 42, 46. The annular channels 74, 76 are still annular passages in the abradable layer 72 whereas, the gaps 48, 50 are interrupted in the cast body due to the lengthening of the vanes 64. As shown in FIG. 5, the portion 78 of each vane in the second gap 50 is angled to catch low momentum, circumferentially traveling gaspath boundary layer air. The camber of each vane 64 is set to turn the air the proper amount to align it with gas path air entering the compressor blade stage. The portion 80 of each vane 64 in the first gap 48 is angled to align the air flowing therethrough with the gas path air entering the compressor blade stage.

The cast construction of the present invention reduces the cost of manufacture by more than half over that of the prior art, making it economically competitive with current untreated shrouds. Casting the inner and outer shroud together eliminates fasteners which are a maintainability and safety concern. The modified vane shape allows casting and provides a structural attachment; the lengthened vane design has allowed the quantity of vanes to be reduced by more than half, while actually increasing the aerodynamic solidity. Thus, there is no compromise in the control of the angle at which the low momentum air is removed from the gaspath and the angle at which that air is injected back into the gaspath. The design is versatile in that the back sheet can be brazed on or cast integrally with process development, and it is space efficient in that the frequent attachment points and elimination of fasteners allows use of thin inner and outer shrouds as compared to the prior art.

Although this invention has been shown and described with respect to detailed embodiments thereof, it will be understood by those skilled in the art that various changes in form and detail thereof may be made without departing from the spirit and scope of the claimed invention.

We claim:

1. A tip shroud assembly for an axial flow gas turbine engine, said tip shroud assembly comprising an annular shroud extending circumferentially about a reference axis, said shroud including a plurality of arcuate segments, each segment comprising a first arcuate member, a second arcuate member, and a third arcuate member interposed between said first and second arcuate members, said third arcuate member in spaced relation to said first arcuate member defining a first gap therebetween, said third arcuate member in spaced relation to said second arcuate member defining a second gap therebetween, each of said arcuate members having a radially inner surface facing said reference axis and a radially outer surface facing away from said reference axis, and said radially inner surface of said third arcuate member substantially defines a section of a cone, a backing sheet, said backing sheet spanning between the first and second arcuate members and sealingly secured to the radially outer surfaces thereof, said backing sheet in spaced relation to the radially outer surface of said third arcuate member, and a plurality of vane walls, each vane wall integral with said first, second and third arcuate members, each vane wall having a first end and a second end, said first end of each vane wall spanning the first gap thereby connecting the radially inner surfaces of the first and third arcuate members, and said second end of each vane wall spanning the second gap thereby connecting the radially inner surfaces of the second and third arcuate members.

2. The tip shroud assembly of claim 1 wherein each of the vane walls extends from the first arcuate member to the second arcuate member, and each of the vane walls extends from the third arcuate member to the backing sheet and is sealingly secured thereto.

3. The tip shroud assembly of claim 2 further comprising a layer of abradable material attached to the radially inner surfaces of the second and third arcuate members and extending radially inward therefrom, said layer having an annular channel extending across the entire segment.

4. The tip shroud assembly of claim 3 wherein the arcuate members and the vane wall are cast as a single piece, and the backing sheet is fastened to said piece.

5. The tip shroud assembly of claim 4 wherein the backing sheet of each segment is brazed to the vane wall and the first and second arcuate members of the segment.

* * * * *

UNITED STATES PATENT AND TRADEMARK OFFICE

CERTIFICATE OF CORRECTION

PATENT NO. : 5,474,417

DATED : December 12, 1995

INVENTOR(S) : John D. Privett et al

It is certified that error appears in the above-indentified patent and that said Letters Patent is hereby corrected as shown below:

In column 2, at line 26, change "mount" to --amount--.

Col. 6, line 16, claim 4, change "vane wall" to —vane walls—.

Col. 6, line 19, claim 5, change "vane wall" to —vane walls—.

Signed and Sealed this

Twenty-sixth Day of March, 1996

*Attest:*

Bruce Lehman

BRUCE LEHMAN

*Attesting Officer*

*Commissioner of Patents and Trademarks*